US011465273B2

(12) United States Patent
Blaine

(10) Patent No.: US 11,465,273 B2
(45) Date of Patent: Oct. 11, 2022

(54) CABINET CREEPER

(71) Applicant: Dow Blaine, Atlanta, GA (US)

(72) Inventor: Dow Blaine, Atlanta, GA (US)

( * ) Notice: Subject to any disclaimer, the term of this patent is extended or adjusted under 35 U.S.C. 154(b) by 169 days.

(21) Appl. No.: 16/929,599

(22) Filed: Jul. 15, 2020

(65) Prior Publication Data

US 2021/0016430 A1 Jan. 21, 2021

Related U.S. Application Data

(60) Provisional application No. 62/874,650, filed on Jul. 16, 2019.

(51) Int. Cl.

| | |
|---|---|
| ***A47C 13/00*** | (2006.01) |
| ***A47C 16/00*** | (2006.01) |
| ***B25H 5/00*** | (2006.01) |
| ***A47C 9/02*** | (2006.01) |
| ***A47C 12/02*** | (2006.01) |
| *A47C 16/04* | (2006.01) |

(52) U.S. Cl.

CPC ..... *B25H 5/00* (2013.01); *A47C 9/027* (2013.01); *A47C 12/02* (2013.01); *A47C 13/00* (2013.01); *A47C 16/04* (2013.01)

(58) Field of Classification Search

CPC ..... A47C 9/025; A47C 9/027; A47C 12/00; A47C 12/02; A47C 13/00; A47C 16/00; A47C 16/04; A47D 11/002; B25H 5/00

USPC ..... 297/1–4, 118, 446.1, 451.12, 447.4; 280/32.5, 32.6; 108/13; 182/33, 33.4

See application file for complete search history.

(56) References Cited

U.S. PATENT DOCUMENTS

| | | | | | |
|---|---|---|---|---|---|
| 872,854 | A | * | 12/1907 | Shepard | A47C 13/00 297/122 |
| 1,104,398 | A | | 7/1914 | Zimmerman | |
| 1,327,103 | A | | 1/1920 | Knowles | |
| 1,394,493 | A | * | 10/1921 | Grazer | A47C 1/146 297/118 |
| 1,712,863 | A | * | 5/1929 | Wickstrum | A47C 16/04 297/187 |
| 2,237,909 | A | * | 4/1941 | Lund | A47C 9/027 182/129 |

(Continued)

FOREIGN PATENT DOCUMENTS

| | | | | | |
|---|---|---|---|---|---|
| EP | 2471415 | A1 | * | 7/2012 | A47C 9/027 |
| GB | 1128835 | A | * | 10/1968 | A47B 85/04 |

(Continued)

*Primary Examiner* — Robert Canfield

(74) *Attorney, Agent, or Firm* — Welsh Flaxman & Gifler LLC

(57) ABSTRACT

A creeper for accessing cabinets includes a first end and a second end. The creeper includes a base support structure having a top surface, a bottom surface, and a plurality of side walls extending between the top surface and the bottom surface. The base support structure also includes a cabinet entry first end that is shaped and dimensioned for positioning within a cabinet and an exposed second end that is shaped and dimensioned to sit outside of the cabinet when cabinet entry first end of the creeper is positioned within the cabinet for use. A downwardly extending leg assembly is secured along the bottom surface of the base support structure. The cabinet creeper may be used for accessing a cabinet or as a seat with the user sitting directly upon the downwardly extending leg assembly.

11 Claims, 5 Drawing Sheets

(56) References Cited

U.S. PATENT DOCUMENTS 2,259,621 A * 10/1941 Dannels ..... A47C 13/00 4/483
2,384,234 A * 9/1945 Breese ..... A47B 85/04 297/423.39
D145,143 S * 7/1946 Pearson ..... D6/349
2,444,618 A * 7/1948 Seamster ..... A47D 13/105 182/222
2,620,018 A * 12/1952 Pagano ..... A47B 85/04 446/482
2,729,905 A * 1/1956 Crozier ..... D06F 81/00 190/11
2,776,700 A * 1/1957 Potter ..... A47D 1/08 297/440.13
3,058,542 A * 10/1962 Rogalla ..... E06C 1/39 182/155
3,334,942 A * 8/1967 Breslow ..... A47D 11/002 297/118
3,436,119 A * 4/1969 Lehmann ..... A47C 13/00 297/118
3,556,586 A * 1/1971 Beardmore ..... A47D 1/04 297/DIG. 2
3,564,787 A * 2/1971 Sherman ..... A47B 87/0253 446/108
3,575,465 A * 4/1971 Dolby ..... A47B 83/00 297/118
3,677,569 A * 7/1972 Larson ..... B62B 3/02 280/32.6
3,704,847 A * 12/1972 Schmitt ..... A47C 9/025 D6/349
3,733,104 A * 5/1973 Carstensen ..... A61G 7/10 5/81.1 R
3,834,776 A * 9/1974 Becker, Jr. ..... A47B 87/0253 297/118
4,185,846 A 1/1980 Black
4,366,998 A * 1/1983 Kaiser ..... B25H 1/12 312/286
4,471,969 A * 9/1984 Zabala ..... A47C 9/00 182/20
4,518,060 A * 5/1985 Natchev ..... A47C 9/027 182/230
D287,283 S * 12/1986 Johnson ..... E04F 11/0201 182/228.1
4,625,833 A * 12/1986 Lewis ..... A01M 31/02 182/187
4,753,320 A * 6/1988 Walter ..... A47C 12/02 182/91
D324,598 S * 3/1992 Clark ..... D34/12
5,092,615 A * 3/1992 Gregalis ..... B62B 3/02 280/30
5,239,934 A 8/1993 Miller et al.
5,330,211 A 7/1994 Nicholson
5,462,219 A 10/1995 Pouet et al.
5,494,305 A 2/1996 Chen
5,503,415 A 4/1996 Powell
5,577,744 A 11/1996 Parks
D383,261 S * 9/1997 Karsten ..... D6/350
5,715,910 A * 2/1998 Koch ..... E06C 7/426 182/33
5,720,522 A * 2/1998 Habeck ..... A47C 15/004 297/195.11
5,733,011 A * 3/1998 Young ..... A47C 9/002 297/195.11
D406,210 S * 3/1999 Johnson ..... D6/601
5,897,122 A 4/1999 Bomer
6,773,063 B2 * 8/2004 Eerkens ..... A47C 13/005 297/440.14
D496,166 S * 9/2004 Namikawa ..... D6/333
6,848,747 B1 * 2/2005 Robinson ..... A47C 4/024 297/440.13
D503,867 S 4/2005 Bennette et al.
7,007,328 B1 * 3/2006 Bailey ..... A47C 16/005 5/640
7,032,908 B2 4/2006 Melvin
D522,264 S * 6/2006 Dekker ..... D6/374
7,066,547 B1 * 6/2006 Russell ..... A47C 16/025 108/115
7,237,781 B2 7/2007 Canova
7,273,215 B1 9/2007 Smith
7,290,552 B1 * 11/2007 Eisbrenner ..... E04H 15/04 135/117
7,305,728 B2 * 12/2007 Schlieps ..... A47C 9/027 5/655.9
7,363,864 B2 4/2008 Broek
7,374,181 B1 5/2008 Wu
7,377,569 B2 5/2008 Taylor et al.
D649,371 S * 11/2011 Wilcox ..... D6/350
8,505,138 B1 8/2013 Minichiello et al.
8,573,607 B2 11/2013 Meacham et al.
9,073,201 B1 7/2015 Foley et al.
9,095,972 B2 8/2015 Meacham et al.
9,126,326 B1 9/2015 Bowen et al.
D770,642 S * 11/2016 Johnson ..... D25/65
9,486,914 B1 * 11/2016 Frolander ..... B25H 5/00
9,609,954 B1 * 4/2017 Hamburg ..... A47C 13/00
D831,364 S * 10/2018 Brown ..... D25/63
10,271,655 B1 * 4/2019 Gwen ..... A47C 4/10
D896,932 S * 9/2020 Staudinger ..... D23/305
10,875,560 B2 * 12/2020 Frolander ..... B62B 5/08
10,925,408 B2 * 2/2021 Nam ..... A61G 13/122
2001/0024022 A1 * 9/2001 Antirose ..... B25H 5/00 280/32.6
2003/0132589 A1 7/2003 Hernandez et al.
2003/0217889 A1 * 11/2003 Sapatova ..... A47C 12/02 182/33
2004/0188292 A1 9/2004 O'Hair
2004/0231918 A1 * 11/2004 Meeker ..... A47C 12/02 182/33
2006/0180097 A1 * 8/2006 Notine ..... A01K 1/035 119/847
2006/0200909 A1 * 9/2006 Beck ..... A47C 9/027 5/652
2006/0225372 A1 * 10/2006 Gonzalez ..... A01K 1/035 52/182
2007/0176378 A1 8/2007 Bangs
2007/0235959 A1 10/2007 Smith
2007/0241523 A1 10/2007 Lewman
2007/0262622 A1 * 11/2007 Tally ..... B25H 5/00 297/183.3
2008/0136129 A1 6/2008 Wu
2011/0017547 A1 * 1/2011 Lee ..... E06C 1/38 182/23
2011/0049822 A1 3/2011 Hinman
2012/0024630 A1 * 2/2012 VanLaningham ..... A01M 31/02 182/116
2012/0074753 A1 * 3/2012 Kalayjian ..... A47C 16/04 297/423.11
2012/0091673 A1 4/2012 Meacham et al.
2013/0111663 A1 * 5/2013 Brown ..... A47C 21/00 5/507.1
2015/0083522 A1 * 3/2015 Chancler ..... A47C 12/00 182/152
2015/0322717 A1 * 11/2015 Gibson ..... A47C 12/00 182/210
2016/0096265 A1 4/2016 Scott et al.
2016/0102468 A1 * 4/2016 Bastien ..... B25H 5/00 182/222
2016/0167221 A1 6/2016 Blaine et al.
2019/0174918 A1 * 6/2019 King ..... A47C 13/00
2020/0190894 A1 * 6/2020 Gunawardena ..... A47L 13/00

FOREIGN PATENT DOCUMENTS

GB 1353433 A * 4/1974 ..... A47D 1/004
GB 2504559 A * 2/2014 ..... A01B 75/00

* cited by examiner

CABINET CREEPER

CROSS REFERENCE TO RELATED APPLICATION

This application claims the benefit of U.S. Provisional Patent Application No. 62/874,650, entitled "CABINET CREEPER," filed Jul. 16, 2019, which is incorporated herein by reference.

BACKGROUND OF THE INVENTION

1. Field of the Invention

The invention relates to a cabinet creeper. In particular, the invention relates to a support structure for users desiring access to a kitchen or bathroom cabinet.

2. Description of the Related Art

Many tools and devices have been developed to improve an individual's ability to conveniently access the interior of a cabinet while lying supine upon a support surface. In particular, plumbers and home improvement do it yourselfers are often confronted with the problem of lying supine while positioning their upper body within a cabinet such that they may work upon plumbing or other mechanical structures within the cabinet.

Various developments have been made to address this problem. For example, U.S. Patent Application Publication No. 2011/0049822 to Hinam discloses a plumber's unibody creeper. This creeper provides a wheeled surface similar to a traditional automotive style floor creeper. Other structures have been developed for providing users with access to the interior compartment of a cabinet. For example, U.S. Pat. No. 3,677,569 to Larson discloses a foldable crawler. The crawler includes a pivotally connected extender. A cabinet with rollers is secured to the underside of the device while wheels are also secured to the extender. U.S. Pat. No. 7,305,728 to Schlieps discloses a plumber support pillow including first and second support cushions arranged to support a plumber. Schlieps also discloses the utilization of lamps for illumination within the cabinet. Further, U.S. Pat. No. 8,505,138 to Minichiello et al. discloses an adjustable back platform device. The device includes a base panel having a plurality of adjustable legs extending therefrom and allowing for usage within the storage compartment of a cabinet. U.S. Patent Application Publication Nos. 2001/0024022 to Antirose, 2006/0200902 to Beck, and 2007/0176378 to Bangs disclose a variety of other support devices utilized by plumbers.

While these devices address a variety of concerns to those desiring access to kitchen and bathroom cabinets while lying in a supine position, the devices also exhibit various shortcomings and do not address all problems confronted by those required to work in such a confined space. With this in mind, Applicant has developed the present creeper which is believed to address the shortcomings and provide a convenient, reliable, and effective creeper for utilization in accessing kitchen and bathroom cabinets.

SUMMARY OF THE INVENTION

In one aspect a creeper for accessing cabinets includes a first end and a second end. The creeper includes a base support structure having a top surface, a bottom surface, and a plurality of side walls extending between the top surface and the bottom surface. The base support structure also includes a cabinet entry first end that is shaped and dimensioned for positioning within a cabinet and an exposed second end that is shaped and dimensioned to sit outside of the cabinet when cabinet entry first end of the creeper is positioned within the cabinet for use. A downwardly extending leg assembly is secured along the bottom surface of the base support structure. The cabinet creeper may be used for accessing a cabinet or as a seat with the user sitting directly upon the downwardly extending leg assembly.

In some embodiments the base support structure is constructed with a substantially rectangular shape when viewed from above and includes a long axis and a short axis.

In some embodiments the plurality of side walls includes first and second long side walls extending parallel to the long axis and first and second short side walls extending parallel to the short axis of the base support structure.

In some embodiments the leg assembly includes a first lateral support leg extending downwardly from the bottom surface of the base support structure at a position between the cabinet entry first end and the exposed second end and the first lateral support leg divides the base support structure into a cabinet entry section that extends from the first lateral support leg to the cabinet entry first end and a lower body support section that extends from the first lateral support leg to the exposed second end.

In some embodiments the first lateral support leg includes an externally facing first planar surface facing the cabinet entry first end of the base support structure and internally facing second planar surface facing the exposed second end of the base support structure.

In some embodiments the leg assembly includes a second lateral support leg that extends downwardly from the bottom surface of the base support structure adjacent the exposed second end thereof.

In some embodiments the second lateral support leg includes an externally facing first planar surface facing the exposed second end of the base support structure and internally facing second planar surface facing the cabinet entry first end of the base support structure.

In some embodiments the creeper includes a support beam extending between the first and second lateral support legs.

In some embodiments the support beam defines a U-shaped profile and is aligned with the long axis of the base support structure.

In some embodiments the support beam includes a central first segment that extends downwardly from the bottom surface of the base support structure, a second segment that extends from the internally facing second planar surface of the second lateral support leg toward the cabinet entry first end, and a third segment that extends from the internally facing second planar surface of the first lateral support leg toward the exposed second end.

In some embodiments the base support structure also includes at least one handle member.

In some embodiments the at least one handle member is an aperture formed along the base support structure.

In some embodiments the base support structure also includes first and second strap apertures.

In some embodiments the first and second strap apertures are adjacent the cabinet entry first end.

In another aspect, a creeper for accessing cabinets includes a first end and a second end. The creeper includes a base support structure having a top surface, a bottom surface, and a plurality of side walls extending between the top surface and the bottom surface. The base support structure also includes a cabinet entry first end that is shaped and dimensioned for positioning within a cabinet and an exposed second end that is shaped and dimensioned to sit outside of the cabinet when cabinet entry first end of the creeper is positioned within the cabinet for use. A downwardly extending leg assembly is secured along the bottom surface of the base support structure. The leg assembly includes a first lateral support leg extending downwardly from the bottom surface of the base support structure at a position between the cabinet entry first end and the exposed second end and the first lateral support leg divides the base support structure into a cabinet entry section that extends from the first lateral support leg to the cabinet entry first end and a lower body support section that extends from the first lateral support leg to the exposed second end. The first lateral support leg includes an externally facing first planar surface facing the cabinet entry first end of the base support structure and internally facing second planar surface facing the exposed second end of the base support structure. The leg assembly also includes a second lateral support leg that extends downwardly from the bottom surface of the base support structure adjacent the exposed second end thereof. The second lateral support leg includes an externally facing first planar surface facing the exposed second end of the base support structure and internally facing second planar surface facing the cabinet entry first end of the base support structure. The cabinet creeper may be used for accessing a cabinet or as a seat with the user sitting directly upon the externally facing first planar surface of the first lateral support leg and the externally facing first planar surface facing of the second lateral support leg sitting upon the ground.

Other advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
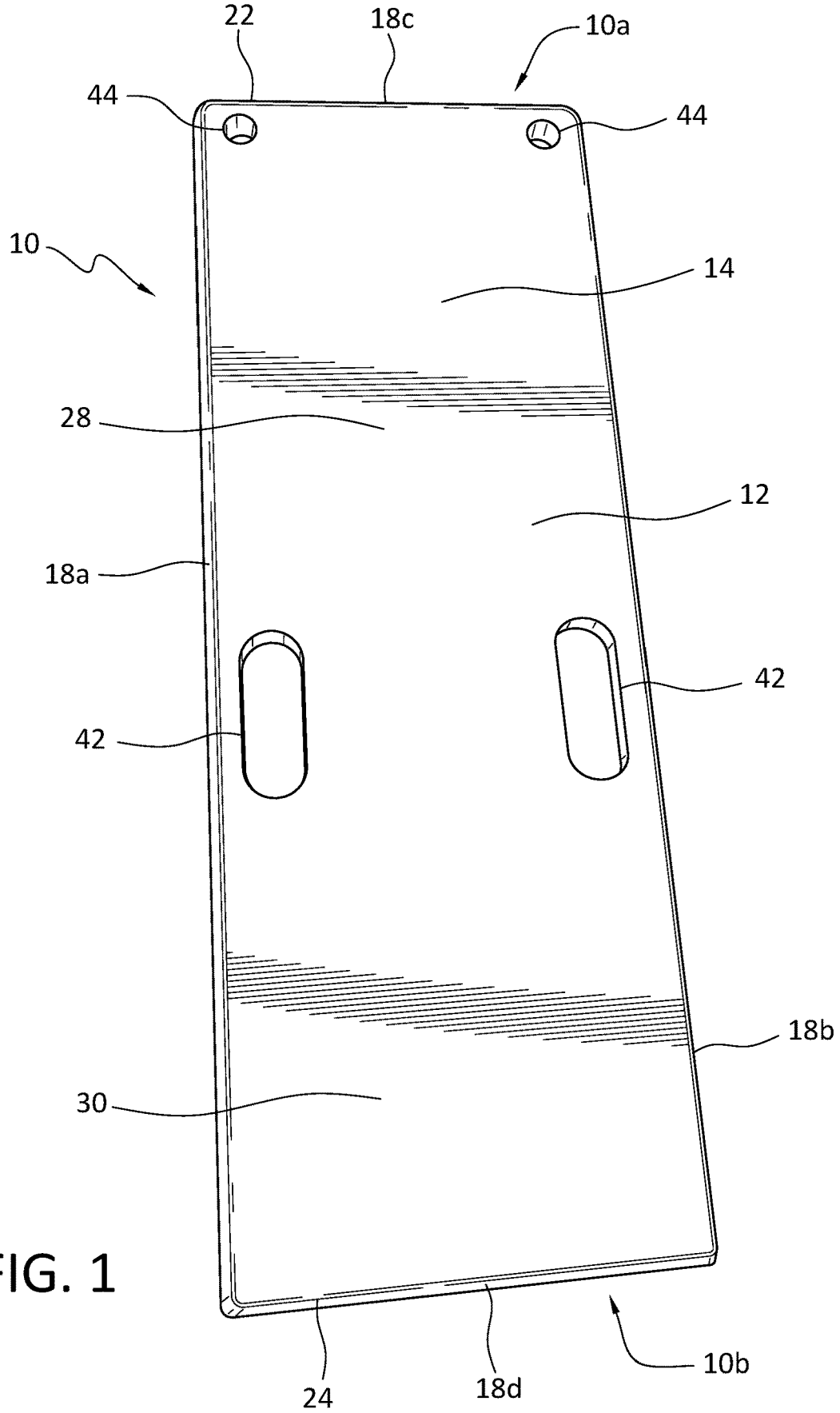
FIG. 1 is a top perspective view of the creeper in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

With reference to FIGS. 1 through 5, a creeper 10 for accessing cabinets is disclosed. The creeper 10 allows an individual to position the creeper 10 in front of a cabinet, rest his/her body upon the creeper, and slide into position within the cabinet.

The creeper 10 includes a first end 10*a* and a second end 10*b*. The creeper 10 also includes a base support structure 12 including a top surface 14, a bottom surface 16, and a plurality of side walls 18*a-d* extending between the top surface 14 and the bottom surface 16. A downwardly extending leg assembly 20 is secured along the bottom surface 16 and provides support to keep the user properly positioned relative to the cabinet in which he or she wishes to work.

The base support structure 12 is constructed with a substantially rectangular shape when viewed from above and thereby includes a long axis and a short axis. The plurality of side walls 18*a-d* therefore includes first and second long side walls 18*a*, 18*b* extending parallel to the long axis and first and second short side walls 18*c*, 18*d* extending parallel to the short axis of the base support structure 12. The base support structure 12 also includes a cabinet entry first end 22 that is shaped and dimensioned for positioning within a cabinet as discussed below in greater detail. The base support structure 12 also includes an exposed second end 24 that is shaped and dimensioned to sit outside of the cabinet when cabinet entry first end 22 of the creeper 10 is positioned within the cabinet for use.

The leg assembly 20 is shaped and dimensioned for placement upon a support surface, for example, a kitchen or bathroom floor. The leg assembly 20 includes a first lateral support leg 26. The first lateral support leg 26 extends downwardly from the bottom surface 16 of the base support structure 12 at a position between the cabinet entry first end 22 and the exposed second end 24. As such, the first lateral support leg 26 may be thought of as dividing the base support structure 12 into a cabinet entry section 28 that extends from the first lateral support leg 26 to the cabinet entry first end 22 and a lower body support section 30 that extends from the first lateral support leg 26 to the exposed second end 24.

The first lateral support leg 26 includes a upper first edge 26*a* joined with the bottom surface 16 of the base support structure 12, a lower second edge 26*b* opposite the upper first edge 26*a* that is dimensioned for contact with the floor when the creeper 10 is positioned within a cabinet, a first lateral edge 26*c* extending between the upper first edge 26*a* and the lower second edge 26*b* along the left side of the creeper 10 (that is, in alignment with the first long side wall 18*a* of the base support structure 12), and a second lateral edge 26*d* extending between the upper first edge 26*a* and the lower second edge 26*b* along the right side of the creeper 10 (that is, in alignment with the second long side wall 18*b* of the base support structure 12). The first lateral support leg 26 also includes an externally facing first planar surface 29 facing the cabinet entry first end 22 of the base support structure 12 and internally facing second planar surface 31 facing the exposed second end 24 of the base support structure 12.

The leg assembly 20 includes a second lateral support leg 32. The second lateral support leg 32 extends downwardly from the bottom surface 16 of the base support structure 12 adjacent the exposed second end 24 thereof. The second lateral support leg 32 includes a upper first edge 32*a* joined with the bottom surface 16 of the base support structure 12, a lower second edge 32*b* opposite the upper first edge 32*a* that is dimensioned for contact with the floor when the creeper 10 is positioned within a cabinet, a first lateral edge 32*c* extending between the upper first edge 32*a* and the lower second edge 32*b* along the left side of the creeper 10 (that is, in alignment with the first long side wall 18*a* of the base support structure 12), and a second lateral edge 32*d* extending between the upper first edge 32*a* and the lower second edge 32*b* along the right side of the creeper 10 (that is, in alignment with the second long side wall 18*b* of the base support structure 12). The second lateral support leg 32 also includes an externally facing first planar surface 34 facing the exposed second end 24 of the base support structure 12 and internally facing second planar surface 36 facing the cabinet entry first end 22 of the base support structure 12.

Figure 2:
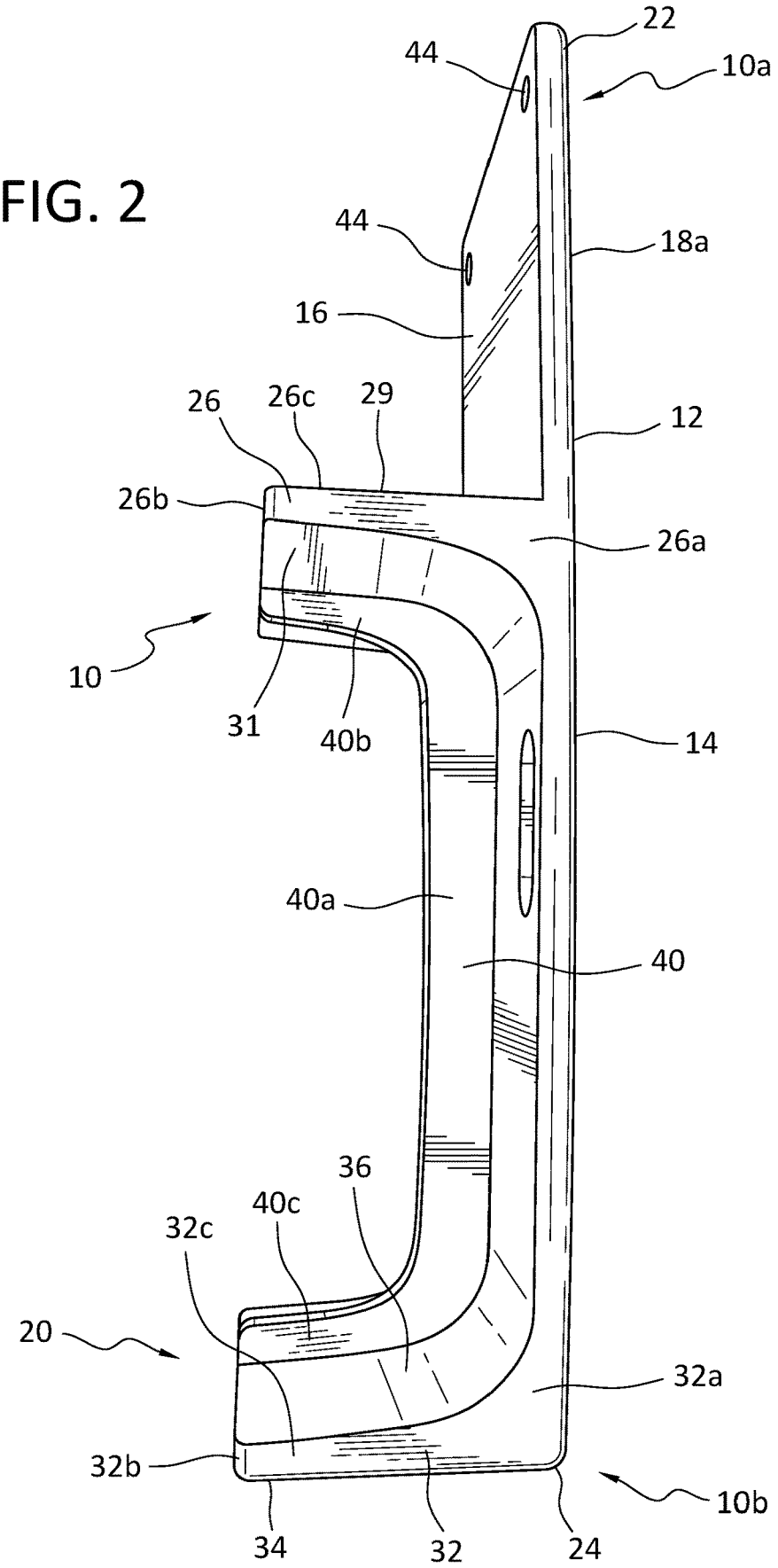
FIG. 2 is a side elevation view of the creeper.
Figure 3:
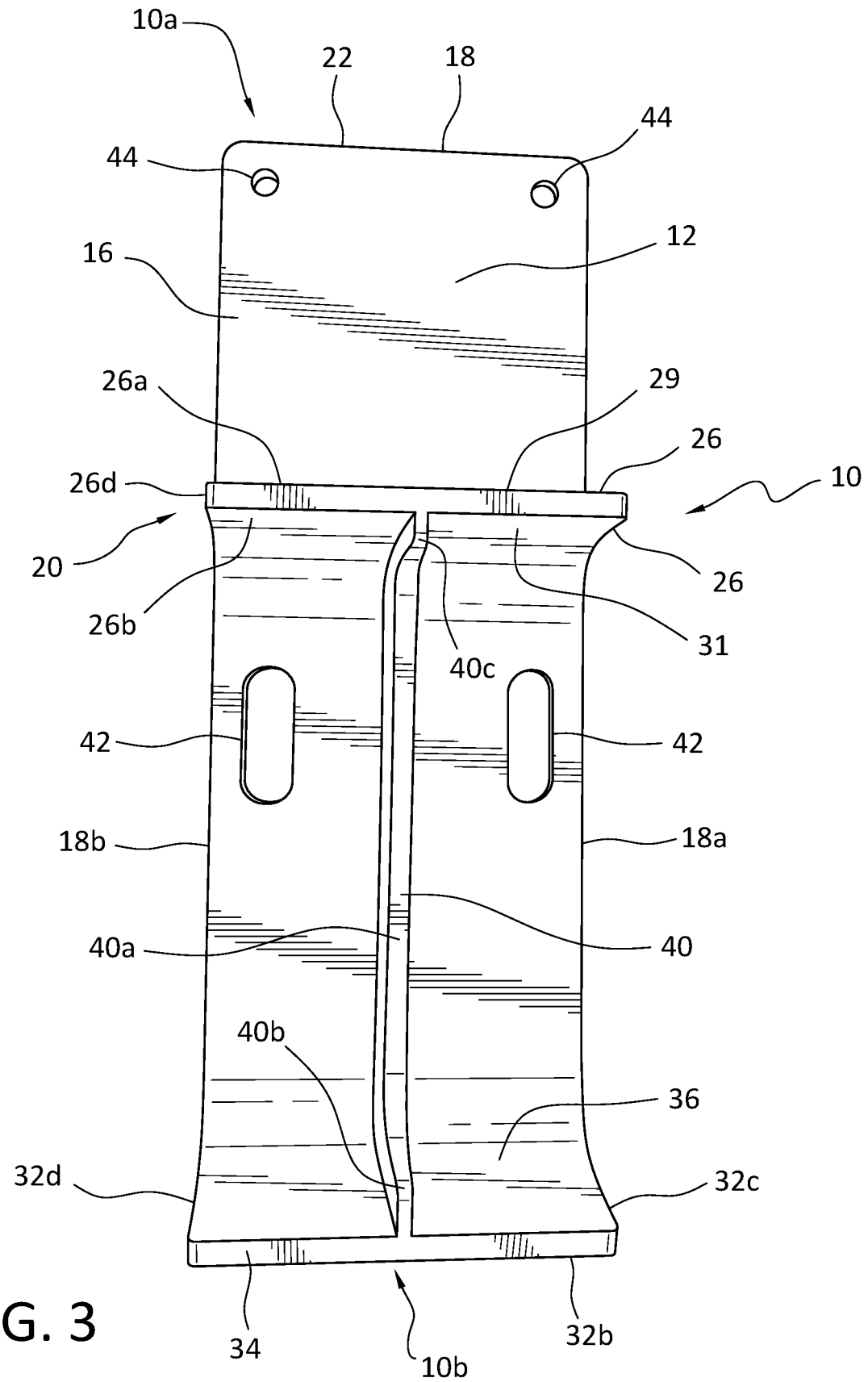
FIG. 3 is a bottom view of the creeper.
Figure 4:
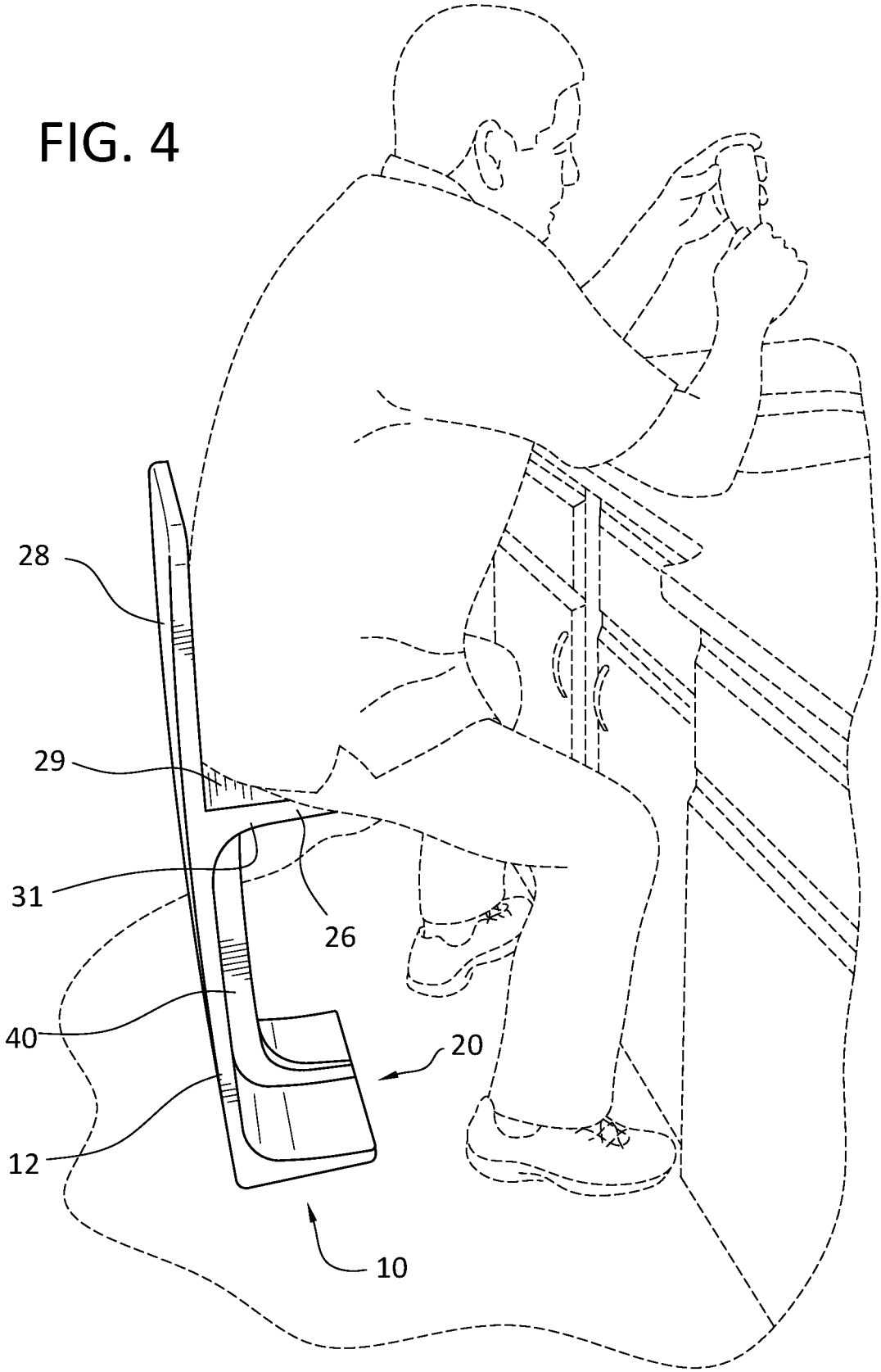
FIG. 4 shows the creeper in use for sitting upon.

Additional stability is achieved by the provision of a support beam 40 extending between the first and second lateral support legs 26, 32. The support beam 40 defines a U-shaped profile when viewed along the left or right side elevation view as shown in FIGS. 2 and 3. The support beam 40 is aligned with the long axis of the base support structure 12 and extends from the first lateral support leg 26 to second lateral support leg 32. In particular, the support beam 40 may be thought of as including three segments, that is a central first segment 40*a* that extends downwardly from the bottom surface 16 of the base support structure 12, a second segment 40*b* that extends from the internally facing second planar surface 36 of the second lateral support leg 32 toward the cabinet entry first end 22, and a third segment 40*c* that extends from the internally facing second planar surface 30 of the first lateral support leg 26 toward the exposed second end 24.

The base support structure 12 also includes handle members 42 formed therein. In particular, the handle members 42 are defined by oblong apertures formed along the lateral sides of the base support structure 12. The base support structure 12 also includes first and second strap apertures 44 adjacent the cabinet entry first end 22 thereof. The strap apertures 44 are shaped and dimensioned for engagement with an elongated strap (not shown) that can be used when carrying the creeper 10. It is further appreciated a strap (not shown) may be extended from one of the strap aperture 44 to one of the handle members 42 to provide an angled strap arrangement for use when positioning the strap over one's shoulder while carrying the creeper 10. It is further appreciated a handle aperture may be positioned between the strap apertures 44.

When the cabinet creeper 10 is positioned for accessing the cabinet, the cabinet entry section 28 of the base support structure 12 is extended into the cabinet while the lower body support section 30 of the base support structure 12 remains fully outside of the cabinet and upon the support surface on which the creeper 10 sits.

Figure 5:
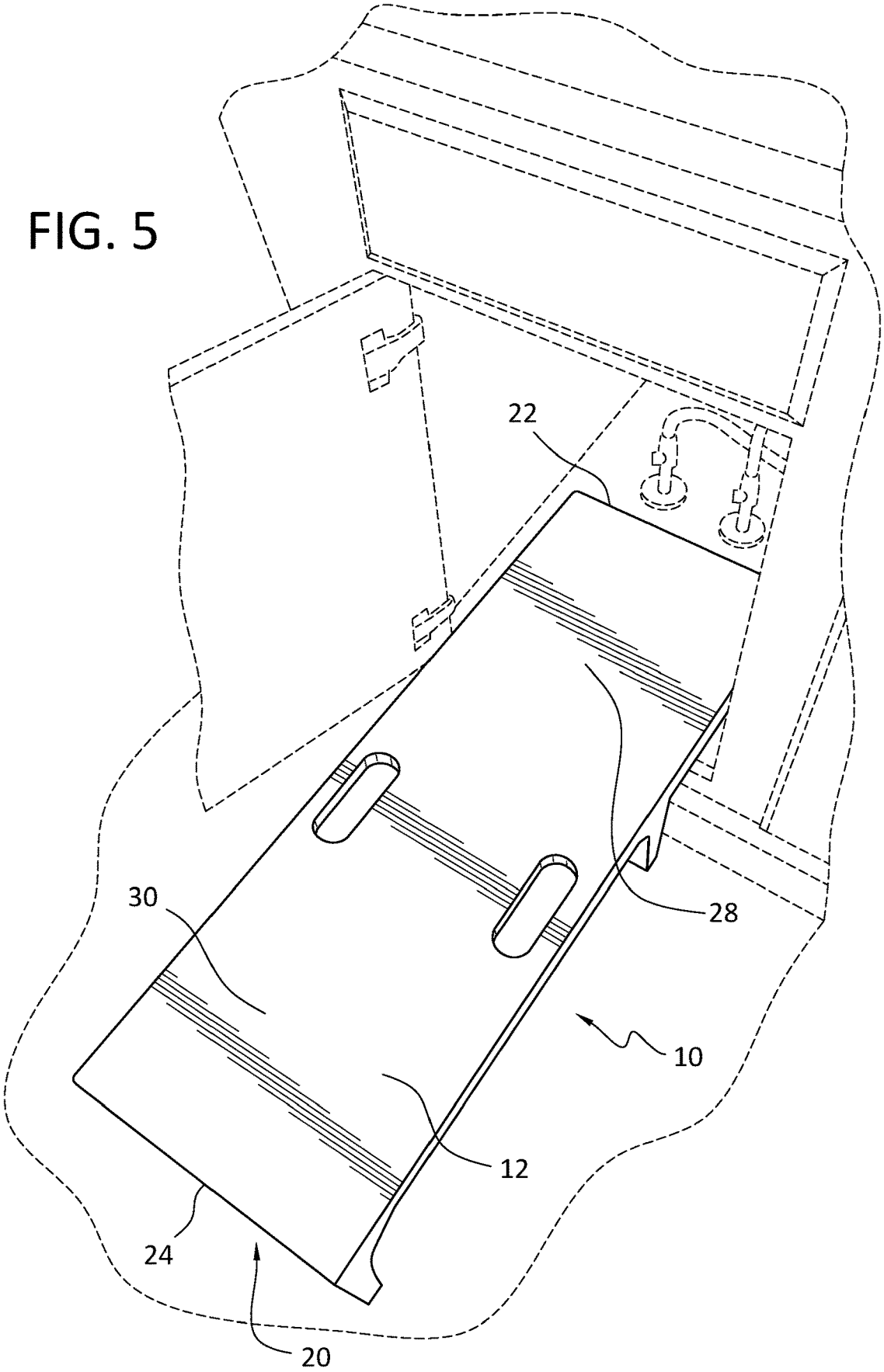
FIG. 5 shows the creeper position in a cabinet ready for use.

In practice, and with reference in particular to FIG. 5, the user positions the creeper 10 adjacent the cabinet into which the user desires to gain access. The creeper 10 is positioned adjacent the cabinet opening such that either the first lateral support leg 26 is oriented such that the externally facing first planar surface 28 is parallel to, and alignment with, the front wall of the cabinet. With the creeper 10 positioned adjacent the cabinet opening and in alignment with the front wall of the cabinet, the user may rest his or her buttock upon the lower body support section 30 of the base support structure 12 and lean backward with his or her back supported by the cabinet entry section 28 of the base support structure 12.

It is further appreciated the versatility of the creeper 10 allows it to be used as a seat. In particular, and with reference to FIG. 4, the externally facing first planar surface 34 of the second lateral support leg 32 is positioned on the floor with the base support structure 12 extending upwardly. The user may then sit upon the externally facing first planar surface 28 of the first lateral support leg 26 with complete stability.

It is appreciated the specific height of cabinets and the openings formed therein vary. As such, the base support structure is positioned at a height that will allow access to a variety of cabinet openings. In accordance with a preferred embodiment, the creeper has the following dimensions: 37½ inches—length; 13½ inches—width; and 8¼ inches—height. Further still, in accordance with a disclosed embodiment, the creeper is of a one-piece construction.

While the preferred embodiments have been shown and described, it will be understood that there is no intent to limit the invention by such disclosure, but rather, it is intended to cover all modifications and alternate constructions falling within the spirit and scope of the invention.

The invention claimed is:

1. A creeper for accessing cabinets including a first end and a second end, comprising:

a base support structure including a top surface, a bottom surface, and a plurality of side walls extending between the top surface and the bottom surface, the base support structure also includes a cabinet entry first end that is shaped and dimensioned for positioning within a cabinet and an exposed second end that is shaped and dimensioned to sit outside of the cabinet when cabinet entry first end of the creeper is positioned within the cabinet for use; and a downwardly extending leg assembly secured along the bottom surface of the base support structure, the leg assembly includes a first lateral support leg extending downwardly from the bottom surface of the base support structure at a position between the cabinet entry first end and the exposed second end and a second lateral support leg that extends downwardly from the bottom surface of the base support structure adjacent the exposed second end thereof, a support beam extending between the first and second lateral support legs, wherein the support beam defines a U-shaped profile and is aligned with a central long axis of the base support structure, the support beam including a central first segment that extends downwardly from the bottom surface of the base support structure, a second segment that extends from an internally facing second planar surface of the second lateral support leg toward the cabinet entry first end, and a third segment that extends from an internally facing second planar surface of the first lateral support leg toward the exposed second end;

wherein the creeper may be used for accessing a cabinet or as a seat with the user sitting directly upon the downwardly extending leg assembly.

2. The creeper according to claim 1, wherein the base support structure is constructed with a substantially rectangular shape when viewed from above and includes a long axis and a short axis.

3. The creeper according to claim 2, wherein the plurality of side walls includes first and second long side walls extending parallel to the long axis and first and second short side walls extending parallel to the short axis of the base support structure.

4. The creeper according to claim 1, wherein the first lateral support leg divides the base support structure into a cabinet entry section that extends from the first lateral support leg to the cabinet entry first end and a lower body support section that extends from the first lateral support leg to the exposed second end.

5. The creeper according to claim 4, wherein the first lateral support leg includes an externally facing first planar surface facing the cabinet entry first end of the base support structure.

6. The creeper according to claim 1, wherein the second lateral support leg includes an externally facing first planar surface facing the exposed second end of the base support structure.

7. The creeper according to claim 1, wherein the base support structure also includes at least one handle member.

8. The creeper according to claim 7, wherein the at least one handle member is an aperture formed along the base support structure.

9. The creeper according to claim 1, wherein the base support structure also includes first and second strap apertures.

10. The creeper according to claim 9, wherein the first and second strap apertures are adjacent the cabinet entry first end.

11. A creeper for accessing cabinets including a first end and a second end, comprising:

a base support structure including a top surface, a bottom surface, and a plurality of side walls extending between the top surface and the bottom surface, the base support structure also includes a cabinet entry first end that is shaped and dimensioned for positioning within a cabinet and an exposed second end that is shaped and dimensioned to sit outside of the cabinet when cabinet entry first end of the creeper is positioned within the cabinet for use; and a downwardly extending leg assembly is secured along the bottom surface of the base support structure, the leg assembly includes:

a first lateral support leg extending downwardly from the bottom surface of the base support structure at a position between the cabinet entry first end and the exposed second end and the first lateral support leg divides the base support structure into a cabinet entry section that extends from the first lateral support leg to the cabinet entry first end and a lower body support section that extends from the first lateral support leg to the exposed second end, wherein the first lateral support leg includes an externally facing first planar surface facing the cabinet entry first end of the base support structure and internally facing second planar surface facing the exposed second end of the base support structure;

a second lateral support leg that extends downwardly from the bottom surface of the base support structure adjacent the exposed second end thereof, the second lateral support leg includes an externally facing first planar surface facing the exposed second end of the base support structure and internally facing second planar surface facing the cabinet entry first end of the base support structure; and a support beam extending between the first and second lateral support legs, wherein the support beam defines a U-shaped profile and is aligned with a central long axis of the base support structure, the support beam including a central first segment that extends downwardly from the bottom surface of the base support structure, a second segment that extends from an internally facing second planar surface of the second lateral support leg toward the cabinet entry first end, and a third segment that extends from an internally facing second planar surface of the first lateral support leg toward the exposed second end;

wherein the cabinet creeper may be used for accessing a cabinet or as a seat with the user sitting directly upon the externally facing first planar surface of the first lateral support leg and the externally facing first planar surface facing of the second lateral support leg sitting upon the ground.

* * * * *